US009920758B2

(12) United States Patent
Strelow et al.

(10) Patent No.: US 9,920,758 B2
(45) Date of Patent: Mar. 20, 2018

(54) ECCENTRIC SCREW PUMP WITH OVERPRESSURE PROTECTION

(71) Applicant: WILO SE, Dortmund (DE)

(72) Inventors: Guenter Strelow, Bochum (DE); Thomas Mueller, Dortmund (DE); Roland Stracke, Unna (DE); Viktor Warkentin, Dortmund (DE)

(73) Assignee: WILO SE, Dortmund (DE)

( * ) Notice: Subject to any disclaimer, the term of this patent is extended or adjusted under 35 U.S.C. 154(b) by 191 days.

(21) Appl. No.: 14/769,351

(22) PCT Filed: Feb. 6, 2014

(86) PCT No.: PCT/EP2014/000320
§ 371 (c)(1),
(2) Date: Aug. 20, 2015

(87) PCT Pub. No.: WO2014/135239
PCT Pub. Date: Sep. 12, 2014

(65) Prior Publication Data

US 2016/0003244 A1 Jan. 7, 2016

(30) Foreign Application Priority Data

Mar. 7, 2013 (DE) ..... 10 2013 003 833

(51) Int. Cl.
*F04C 2/107* (2006.01)
*F04C 14/28* (2006.01)
*F01C 1/10* (2006.01)

(52) U.S. Cl.
CPC ..... *F04C 14/28* (2013.01); *F01C 1/10* (2013.01); *F04C 2/1075* (2013.01); *F04C 2/1076* (2013.01); *F04C 2250/30* (2013.01)

(58) Field of Classification Search
CPC .. F04C 2250/30; F04C 2/1075; F04C 2/1076; F01C 1/10
USPC ..... 418/48–67, 160–177, 191–204
See application file for complete search history.

(56) References Cited

U.S. PATENT DOCUMENTS

| | | | |
|---|---|---|---|
| 2,612,845 | A | 10/1952 | Byram |
| 2,691,347 | A | 10/1954 | Zimmer |
| 3,802,803 | A | 4/1974 | Bogdanov |
| 5,318,416 | A | 6/1994 | Hantschk |
| 2010/0092317 | A1 | 4/2010 | Suhara et al. |

FOREIGN PATENT DOCUMENTS

| | | | |
|---|---|---|---|
| CN | 1791750 | A | 6/2006 |
| DE | 602107 | B | 8/1934 |

*Primary Examiner* — Mary A Davis
(74) *Attorney, Agent, or Firm* — Andrew Wilford

(57) ABSTRACT

An eccentric screw pump comprising an outer part (2) and an inner part (3) therein, one of the parts (2, 3) being driven rotatably and the other part (2, 3) being able to move eccentrically relative to the other part (3, 2). The screwthreads (5*a*, 5*b*) of the outer part (2) extend angularly over less than an entire helix along the axial length (L) of the part, so that during operation pumping chambers that are open to both ends are created, through which sudden pressure relief takes place.

5 Claims, 1 Drawing Sheet

ECCENTRIC SCREW PUMP WITH OVERPRESSURE PROTECTION

CROSS REFERENCE TO RELATED APPLICATIONS

Figure 1:
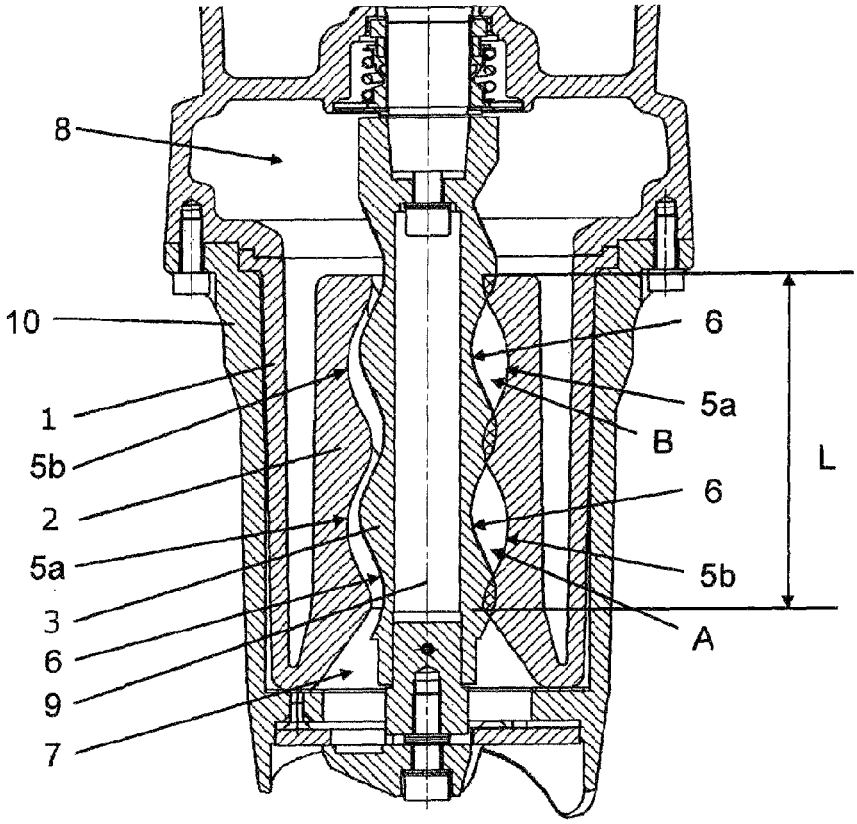

This application is the US-national stage of PCT application PCT/EP2014/000320 filed 6 Feb. 2014 and claiming the priority of German patent application 102013003833.2 itself filed 7 Mar. 2013.

FIELD OF THE INVENTION

The invention relates to a pump for moving a medium to be displaced from an intake end to an output end, comprising an outer part and an inner part arranged therein, one of the parts being driven rotatably and the other part being able to move eccentrically relative to the one part. The inner part has at least one screwthread extending helically and axially, and the outer part has a number of screwthreads that is greater by one than the inner part. The ratio of the number of screwthreads in every cross-section is identical to the ratio of the pitches of the screwthreads, and the outer part and the inner part make contact in such a way that the parts form pumping chambers that can be moved axially by rotating the one part relative to the one part so that the medium to be displaced can be displaced from the intake end to the output end.

BACKGROUND OF THE INVENTION

Such a pump is known as an eccentric screw pump and is based on the idea by Rene Moineau described in the German patent DE 602,017. This patent describes a device comprising an outer part and an inner part each provided with screwthreads, the outer part having exactly one screwthread more than the inner part. The ratio of the pitch on the outer part to the pitch on the inner part in every cross-section corresponds to the ratio of the number of screwthreads on the respective parts. The inner and outer parts thus form closed pumping chambers that move axially from the intake end to the output end during relative rotation of the inner part in the outer part. If this device is to be used as a pump, according to the comments in DE 602,017 the device must always have at least one closed pumping chamber between the intake end and output end. This means that the screwthreads of the outer part must have an entire turn.

Various designs of eccentric screw pumps are known. For example, the inner part may be driven and act as the rotor, while the outer part remains stationary and is the stator. However, designs comprising an outer rotor and an inner stator are also possible. In both variants, designs are possible in which either the inner part moves radially eccentrically relative to the outer part, for example as in DE 602,017, or the outer part moves radially eccentrically relative to the inner part. The latter variant, which also comprises a rotatably driven inner part, is described in U.S. Pat. Nos. 2,612,845 and 2,691,347. In the eccentric screw pumps disclosed there, the stationary outer part (the pump stator) is made of an elastic material and is deformed so as to move on a circular path around the central pump rotor axis and thereby compensate for the eccentricity between the inner rotating part (pump rotor) and the outer part. The outer part is therefore also referred to as a vibrating stator or wobble stator. In this way, the joint in the drive train necessary in the otherwise standard eccentric screw pumps comprising pipe stators may be dispensed with, so that eccentric screw pumps comprising wobble stators can be produced considerably shorter and less expensively.

Eccentric screw pumps belong to the group of rotary positive displacement equipment. During operation, they continuously pump medium with the pumping chambers, which is to say by means of the enclosed pumping chambers between the inner part and the outer part, to the output end. If an enclosed volume is present on the output end, for example due to a closed valve, in particular a flow restriction, pressure builds continuously in the enclosed volume. Without suitable measures, the pump will continue to deliver medium to be displaced through the moving, closed pumping chambers from the intake end to the output end, and the pressure rises drastically at the output. In the waste water technology field, in which the described pumps are preferably used, output-end throttling can be caused by a closed gate valve, for example, or else by the accumulation of fragments of the waste water in the pipe. The pressure buildup at the output-end can result in destruction of the pump or of the system connected to the pump.

So as to protect the pressurized system, monitoring devices such as pressure sensors must be provided on the one hand, and protective measures such as deactivation of the pump or pressure relief devices must be provided on the other hand. The latter may be safety valves, bursting diaphragms or bypass lines that can be opened, for example.

Safety valves are associated with the risk of becoming clogged with fragmented components of the waste water, which can accumulate in the flow-conducting components of the valve. Bursting diaphragms relieve a pressurized system by being destroyed when the bursting pressure is applied and by exposing an opening so that the pressurized medium to be displaced can be discharged. Replacement of the destroyed bursting diaphragm is required to put the system back in operation. In addition, the service life is dependent on the ratio of the actual operating pressure to the bursting pressure, so that the bursting diaphragm may become predamaged, for example as a result of brief pressure surges, and then bursts at a lower pressure. Another disadvantage of bursting diaphragms is the relatively high price. A closed valve or a clogged location downstream of the pump can be circumvented by using a bypass line. However, this necessitates increased piping complexity, requires installation volume, and thus results in increased installation costs.

OBJECT OF THE INVENTION

Against this background, it is the object of the present invention to provide an eccentric screw pump that has integrated protection against output-end overpressure, so that destruction of the system connected to the pump is effectively prevented and pressure relief devices can be dispensed with.

SUMMARY OF THE INVENTION

This object is achieved by a pump for delivering a medium to be displaced from an intake end to an output end comprising an outer part and an inner part arranged therein, one of the parts being driven rotatably and the other part being able to move eccentrically relative to the one part, and the inner part has at least one screwthread extending helically and axially, and the outer part has a number of screwthreads that is greater by one than the inner part, the ratio of the number of screwthreads in every cross-section being identical to the ratio of the pitches of the screwthreads, and the outer part and the inner part making contact in such a way that the parts form pumping chambers that are moved axially by rotating the one part relative to the other part so that the medium to be displaced can be displaced from the intake end to the output end, the screwthreads of the outer part along the axial length of the part extending angularly over less than an entire helix.

The basic idea of the present invention is thus to shorten the axial length of the outer part compared to the known designs of eccentric screw pump in such a way that the screwthreads of the outer part do not wind an entire 360° around the axis of the outer part. The result of this is that enclosed chambers are not present at all times between the inner part and the outer part. Rather, as one part is rotated relative to the other part, there is a moment, which is to say a position of the parts relative to each other, in which each pumping chamber is open both to the intake end and to the output end. In this way, overpressure building on the output end can be reduced toward the intake end.

Conventional eccentric screw pumps use stationary outer parts (stators) whose screwthreads have more than one turn. Patent DE 602,017 expressly points out that the use of a device comprising an inner part and an outer part of the type in question requires at least one enclosed pumping chamber between these two parts, and the screws of the outer part must have at least one screwthread.

Surprisingly, however, it was found as part of the invention that this is not necessarily so. The present invention therefore conflicts with the aforementioned technical teaching.

For example, when an inner part having a single screwthread and correspondingly an outer part having two screwthreads is used in a conventional eccentric screw pump, the outer part has exactly one complete screwthread and the two parts make contact with each other in such a way that, as seen in axial section, a sub-section of the inner part is seated in a respective sub-section of the two screwthreads of the outer part in an approximately form-locked manner. The resulting contact areas delimit a respective pumping chamber. The pumping chambers extend spirally axially and move angularly and axially along this spiral when the one part is rotated relative to the other part. This means that the contact areas between the inner and outer parts also migrate helicoidally.

When the leading end of a first pumping chamber reaches the output end and the one part continues to be rotated, this pumping chamber then opens to the output end. At the same time, the pumping chamber has just closed on the intake end, which is to say at the rear end thereof in the spiral direction. In the position of the two parts relative to each other, in which the leading end has just reached the output end, two sub-sections of the inner part are consequently inserted in the screwthread of the outer part delimiting the respective pumping chamber, namely a sub-section in the region of the intake end and a sub-section in the region of the output end. Looking at the second screwthread of the outer part, in the considered position a sub-section of the inner part is just inserted in the axial center of the two parts in this second screwthread. This means that in this position a second and a third pumping chamber exist in the second screwthread, each of which is half open. The second pumping chamber located at the front in the spiral direction is open to the output end, and the third pumping chamber located at the back in the spiral direction is open to the intake end.

In the considered rotational position of the two parts relative to each other, it becomes clear that shortening the length of the outer part such that the screwthreads thereof do not have a full turn causes the first pumping chamber to not be closed (any longer) at the leading end. Rather, the chamber is open. If the two parts are now rotated back slightly, so that the first pumping chamber is not yet closed on the intake end, it becomes apparent that the pumping chamber is no longer completely closed in this position. Rather, it is not closed any longer on either end, which is to say it is open on both ends. In contrast, the second and third pumping chambers are closed on one end, the second, front pumping chamber being closed to the back in the spiral direction, and the third, rear pumping chamber being closed to the front in the spiral direction. As a result, no pumping chamber that is is completely closed exists any longer.

If the one part is rotated further 180°, the leading end of the third pumping chamber reaches the output end and opens there, while this pumping chamber has not yet closed completely on the intake end.

At the described points in time and at the described relative positions of the parts, pressure building on the output end briefly results in flow from the pressure end (output end) to the suction end (intake end) through the pumping chamber that is open on both ends, which is to say an inner leak between the intake end and the output, and thus in a sudden pressure decrease.

This leakage in the pump hydraulic system causes a decrease in the delivery head. As a result of the design of an eccentric screw pump according to the invention, it is therefore possible to set a defined leakage, which is to say a predetermined maximum delivery head. The axial length of the outer part, and consequently the length of the helix, can thus be deliberately selected so that a predetermined maximal delivery head $H_{nominal}$ is achieved at a predetermined operating point at small delivery volume flows.

By shortening the outer part according to the invention, it is thus possible to set the maximum delivery head of the pump, without requiring further components and without negatively influencing the hydraulic efficiency of the pump at a favorably selected shortening length.

In addition, the operating safety of the pump is higher. There is no longer need of bursting diaphragms that would be destroyed at excessively high pressures and cause the pump to not be operational until the bursting diaphragm is replaced. Moreover, no pressure control valves, which are prone to clogging, would be required any longer. This contributes to a reduction of the installation costs.

The screwthreads of the outer part are preferably externding around only between 75% and 95% of an entire helix along the axial length of the part. This range ensures that pressure is reduced effectively through the pumping chamber open on both ends, without impairing the flow rate delivery capacity too drastically.

Different variants are possible for the pump according to the invention. For example, either the inner part of the outer part may be driven rotatably. Furthermore, it is possible in both of these variants for the inner part to move eccentrically relative to the outer part, in particular on a circular path, or for the outer part to move eccentrically relative to the inner part, in particular on a circular path. It is preferred for the outer part to move eccentrically around the axis of the inner part and for the the inner part to be rotatably driven as the rotor, so the outer part is the stator. This has the advantage that complex joints may be dispensed with for moving the parts on an eccentric path.

The outer part is preferably made of an elastomeric material. This has the advantage that the outer part can be deformed, and low-wear frictionally engaged contact is achieved between the inner and outer parts. Moreover, the outer part can preferably be held at one of the axial ends thereof at the pump housing by an elastic support structure. The elastic support structure allows the outer part to move eccentrically relative to the inner part on a circular orbit. Due to the one-sided attachment, the outer part vibrates virtually freely like a wobble stator.

BRIEF DESCRIPTION OF THE INVENTION

Figure 2:
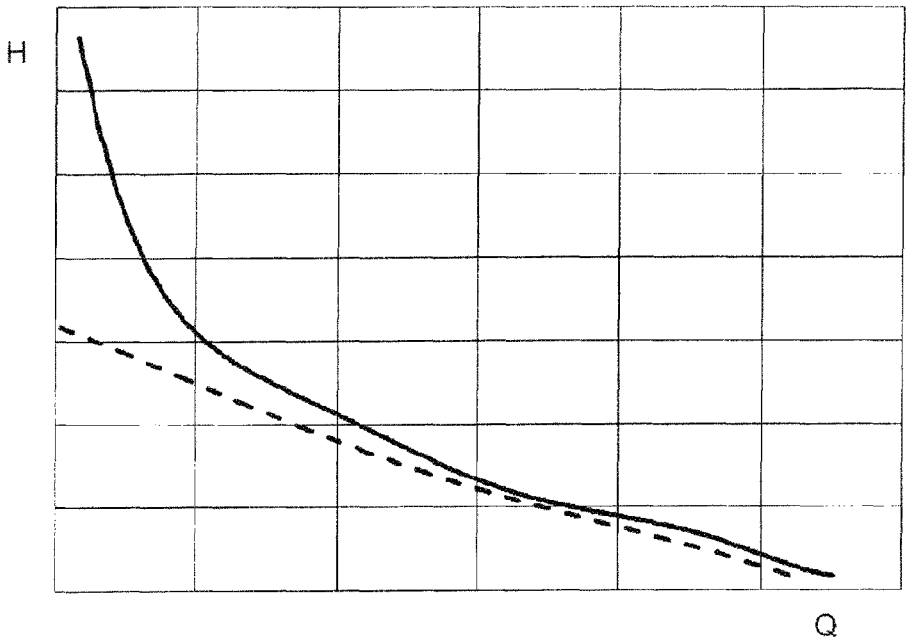

Further features and advantages of the invention are described hereafter based on the embodiment shown in FIG. 1. In the drawings:

FIG. 1 is an axial section through an eccentric screw pump according to the invention; and FIG. 2 is a graph of the dependence of the maximum delivery head on the stator length.

SPECIFIC DESCRIPTION OF THE INVENTION

FIG. 1 shows an eccentric screw pump. It has an intake end 7 and an output end 8. A medium to be pumped is moved from the intake end to the output end during operation of the pump.

The pump comprises an outer part 2 and an inner part 3 therein. Of these parts, the inner part 3 is driven. It forms the rotor of the eccentric screw pump and rotates around an axis 9. During operation, the outer part 2 moves radially eccentrically relative to the inner part 3 on a circular path around the axis 9. However, compared to the rotational movement of the inner part 3, the outer part 2 is stationary and is therefore referred to as the stator. The outer part 2 is approximately cylindrical and, at its end close to the intake end 7, merges in one piece into an outer elastic support structure 1. This support structure 1, along with the outer part 2, is formed from an elastomeric plastic material. The support structure 1 and the outer part 2 together form the stator of the eccentric screw pump, and the support structure 1 is attached to a pump housing 10. The part located between this support structure 1 and the rotor or inner part 3 is thus the inner stator part 2. Since this inner stator part is made of an elastomeric material and at one end integrally merges into the is structure 1 forming the outer stator part, it vibrates quasi freely relative to the rotor and is deformed during eccentric movement thereof around the rotor 3 in such that the eccentricity between the pump rotor 3 and pump stator 2 is compensated for. Such a system is therefore also referred to as a wobble stator.

The inner part or rotor 3 has exactly one outer screwthread 6 extending helically and axially. In contrast, the inner surface of the outer part 2 (stator inner part) has a number of screwthreads 5*a*, 5*b* that is higher by one than the inner part 3, namely two screwthreads that also extend helically and axially. It is noted out that FIG. 1 shall be understood purely by way of example and that any arbitrary other number of screwthreads is possible. Moreover, the profiles of the inner part 3 and of the outer part 2, which is to say the outer profile of the inner part 3 and the inner profile of the outer part 2, can be arbitrary, they can in particular have any one of the profile shapes shown in DE 602107.

The ratio of the number of screwthreads 5*a*, 5*b*: 6 is 1:2 here. The pitches of the screwthreads of the outer part 2 and inner part 3 are selected so that in every cross-section the ratio of the pitches of the screwthreads 5*a*, 5*b*: 6 is identical to the ratio of the number of screwthreads 5*a*, 5*b*: 6. It is apparent from FIG. 1 that the pitches of the internal screwthread 5*a*, 5*b* of the outer part 2 are considerably larger than the pitch of the external screwthread of the inner part 3. The external screwthread 6 of the inner part 3 has two full turns, which is to say it extends along two full helices axially. Due to the higher pitch, the internal screwthreads 5*a*, 5*b* would only have one full turn along the same axial length as the rotor 3.

The outer part 2 and the inner part 3 make contact with each other such that pumping chambers A, B are formed between them that can be moved axially by rotating the inner part 3 relative to the outer part 2, so that the medium to be displaced can be displaced from the intake end 7 to the output end 8.

According to the invention, the screwthreads 5*a*, 5*b* of the outer part 2, which is to say of the inner stator part 2, extend through less than an entire helix. This means that the axial length L of the inner stator part 2 is shorter compared to a conventional stator of an eccentric screw pump, in which the internal screwthread extends at least through a full helix. As was already described above, this causes the pumping chambers A, B to no longer be completely closed. If the rotor 3 is rotating into such a position in which a pumping chamber on the intake end 7 is in the process of closing, this pumping chamber has just opened on the output end 8, and medium to be displaced briefly flows back through the pumping chamber, which is now open on both ends, and a small portion of the pressure on the output end 8 is reduced. The return flow is higher, the higher the pressure on the output end. In this way, this effectively prevents damage to the pump and/or to the system connected to the pump when the pump is operating against a closed valve or a clog in the output pipe.

What is interesting is that the measure according to the invention increases the efficiency of the pump, since lower friction losses occur between the inner part 3 and the outer part 2 due to the shortened stator.

As a result of the reduction in pressure, the maximum delivery head of the pump is reduced. This effect is more pronounced the lower the displaced volume rate is. FIG. 2 shows is measured normalized hydraulic characteristic curves for a pump comprising a conventional stator 2 (solid line), in which the stator length L is greater than the screwthread pitch $H_{st}$, and for a stator 2 according to the invention having a stator length L smaller than the screwthread pitch $H_{ast}$ (dotted line). The figures for the delivery head H and the flow rate Q are normalized to the maximum values $H_{nom}$ and $Q_{nom}$. It becomes apparent that shortening the stator length L such that the screwthreads 5*a*, 5*b* of the outer part 2 extend around less than an entire helix has hardly an effect relative to the delivery head H at medium, and in particular at higher, flow rates Q.

Insofar it has been shown that an eccentric screw pump does not necessarily have to comprise at least one enclosed pump chamber between the inner part 3 and the outer part 2, which is to say that the screwthreads of the outer part must have at least one turn, as is described in DE 602107. Rather, a stator 2 that is shorted compared to this technical teaching may also be used, which surprisingly results in the described pressure reduction on the pressure end 8, and moreover during operation even results in increased efficiency.

The invention claimed is:

1. A pump for displacing a medium and comprising:

a housing having an intake end and an output end;

an outer part in the housing;

an inner part inside the outer part, one of the inner and outer parts being driven rotatably about an axis of the one of the inner and outer parts and the other of the inner and outer parts being able to move eccentrically relative to the one of the inner and outer parts;

at least one screwthread extending helically and axially on the inner part; and a number of screwthreads on the outer part that is greater by one than a number of screwthreads on the inner part, the ratio of the number of screwthreads in every cross-section being identical to the ratio of the pitches of the screwthreads, and the outer part and the inner part making contact in such a way that the inner and outer parts form pumping chambers that move axially on rotation of the one of the inner and outer parts relative to the other of the inner and outer parts so that the medium to be displaced is displaced from the intake end to the output end, the screwthreads of the outer part extending angularly over less than an entire helix along an axial length of the outer part such that on each revolution of the one of the inner and outer parts about the axis opposite ends of each chamber both open briefly at both the intake end and the output end.

2. The pump according to claim 1, wherein the screwthreads of the outer part extend angularly only through between 75% and 95% of an entire helix along the axial length of the outer part.

3. The pump according to claim 1, wherein the outer part is the other of the inner and outer parts and is eccentrically movable around the axis of the inner part, and the inner part is the one of the inner and outer parts and is rotatably driven.

4. The pump according to claim 1, wherein the outer part is made of an elastomeric material and at one of its axial ends is held on the housing via an elastic support structure.

5. The pump according to claim 1, wherein the axial length of the outer part is selected such that the pump has a predetermined maximum delivery head.

* * * * *